US005571433A

United States Patent [19]

Baker

[11] Patent Number: 5,571,433

[45] Date of Patent: Nov. 5, 1996

[54] LOW TEMPERATURE SELF CLEAN FOR OVENS

[75] Inventor: Richard L. Baker, Lewisburg, Ohio

[73] Assignee: Whirlpool Corporation, Benton Harbor, Mich.

[21] Appl. No.: 365,582

[22] Filed: Dec. 28, 1994

[51] Int. Cl.[6] ..... A21B 1/40

[52] U.S. Cl. ..... 219/413; 219/398; 219/486

[58] Field of Search ..... 219/391, 393, 219/395, 396, 397, 398, 412, 413, 483, 484, 486

[56] References Cited

U.S. PATENT DOCUMENTS

| | | | |
|---|---|---|---|
| 3,668,371 | 6/1972 | Fry et al. | 219/413 |
| 3,739,146 | 6/1973 | Gilliom | 219/393 |
| 4,051,347 | 9/1977 | Röhrl et al. | 219/400 |
| 4,238,670 | 12/1980 | Maitenaz | 219/413 |
| 4,493,976 | 1/1985 | Wilson | 219/398 |
| 4,775,777 | 10/1988 | Sinn | 219/397 |
| 4,852,544 | 8/1989 | Williams et al. | 219/413 |
| 4,904,849 | 2/1990 | Sinn | 219/413 |

FOREIGN PATENT DOCUMENTS 2-230685 9/1990 Japan .

*Primary Examiner*—Teresa J. Walberg
*Assistant Examiner*—J. Pelham
*Attorney, Agent, or Firm*—Hill, Steadman & Simpson

[57] ABSTRACT

A temperature control system for a self-cleaning oven and a method for operating in a clean mode for a self-cleaning oven are provided. The control system and the method allow for cleaning of the oven in a clean mode between a maximum temperature and a minimum temperature over the time period required for cleaning the oven. The maximum temperature is reached at least once during the clean mode and is, preferably, cycled to reach the maximum temperature a number of times during the clean mode. As a result of the cycling during the clean mode, a significantly reduced average temperature is required for cleaning of the oven during its self-cleaning operation.

16 Claims, 3 Drawing Sheets

LOW TEMPERATURE SELF CLEAN FOR OVENS

BACKGROUND OF THE INVENTION

A. Field of the Invention

The present invention generally relates to temperature control systems and methods, and, more particularly, to a new self-cleaning oven control system and method.

B. Description of the Prior Art

Self-cleaning ovens and temperature controls therefor are well known in the art as exemplified by U.S. Pat. Nos. 4,775,777 and 4,904,849. Conventionally, bake temperature controls for self-cleaning ovens are capable of recalibration and service to compensate for oven components that deviate from design specification or to accommodate individual user preferences. Some temperature control systems for self-cleaning ovens are designed to maintain a constant clean temperature even though the bake temperatures have been recalibrated and offset by a predetermined amount from nominal values. Recalibration of the bake temperatures in [illegible]n systems necessarily affects the clean temperature.

With the advent of digital electronic microprocessor based control systems for controlling the temperature in self-cleaning ovens, specific operating characteristics are inherent in a particular design of the control system. For example, in a specific electric range commercially made and sold by the assignee of the present invention, the digital electronic microprocessor based closed-loop control circuit for controlling the temperature of a self-cleaning oven of the range provides a much finer or greater level of temperature control resolution in the bake mode than in the clean mode.

Furthermore, the average temperature required to provide cleaning in known self-cleaning ovens is extremely high requiring the use of components, both electrical and mechanical, rated for use in such high temperatures. Further, use of high temperatures requires a significantly longer "cool down" time following the clean mode of operation of the self-cleaning oven.

It is, however, a problem to effect cleaning at lower temperatures than what has previously been implemented. That is, some animal fats, for example, will not vaporize at temperatures less than 770° F. Further, smoke produced during the cleaning mode of operation has always been significant in known systems operating at very high temperatures during the clean mode.

A need, therefore, exists to provide an improved clean mode of operation of a self-cleaning oven using an average temperature significantly lower than known temperatures required for self-cleaning of such ovens.

SUMMARY OF THE INVENTION

The present invention relates to domestic appliances and more particularly to self-cleaning ovens and a method for cleaning such ovens wherein average temperatures required for cleaning the oven in a clean mode are significantly reduced.

It is, therefore, an object of the invention to provide a new self-cleaning oven temperature control system and a method for cleaning the oven.

Another object of the present invention is to provide a new temperature control system and method for a self-cleaning oven in which the average temperature is significantly reduced during cleaning thereby allowing use of lower-rated components, reduction of smoke during the clean mode and a quicker cool-down time following the clean mode of operation.

Briefly, the present invention provides a new self-cleaning oven temperature control system and method. The self-cleaning oven provides a housing with an interior constructed and arranged to receive items to be cooked within the housing. Heating means are provided within the housing wherein the heating means raises the temperature of the interior of the housing. A control means is provided and is operative to control operation in a plurality of modes including a clean mode. The control means is operatively connected to the heating means to maintain a self-cleaning temperature in the housing. The control means maintains an average self-cleaning temperature of under 800° F.

In accordance with the present invention, a method is also provided for controlling operation of a self-cleaning oven having a housing with an interior, heating means within the interior for raising the temperature of the interior and a controller for operating the oven in at least a bake mode and a clean mode. The method comprises the steps of selecting the mode of operation for the interior of the housing, sensing the temperature of the interior during the clean mode and controlling the heating means during the operation of the oven in the clean mode wherein an average cleaning temperature does not exceed 800° F.

In accordance with another feature of the present invention, a method is provided for maintaining an average cleaning temperature below an average normally required for cleaning a self-cleaning oven. The method comprises the steps of selecting a clean mode of operation for the oven, increasing the temperature within the oven to a first temperature, decreasing the temperature within the oven to a second temperature substantially below the first temperature. and automatically cycling the temperature alternately between the first temperature and the second temperature to provide an average temperature in the clean mode of operation of the oven.

DETAILED DESCRIPTION OF THE PREFERRED EMBODIMENTS

Figure 1:
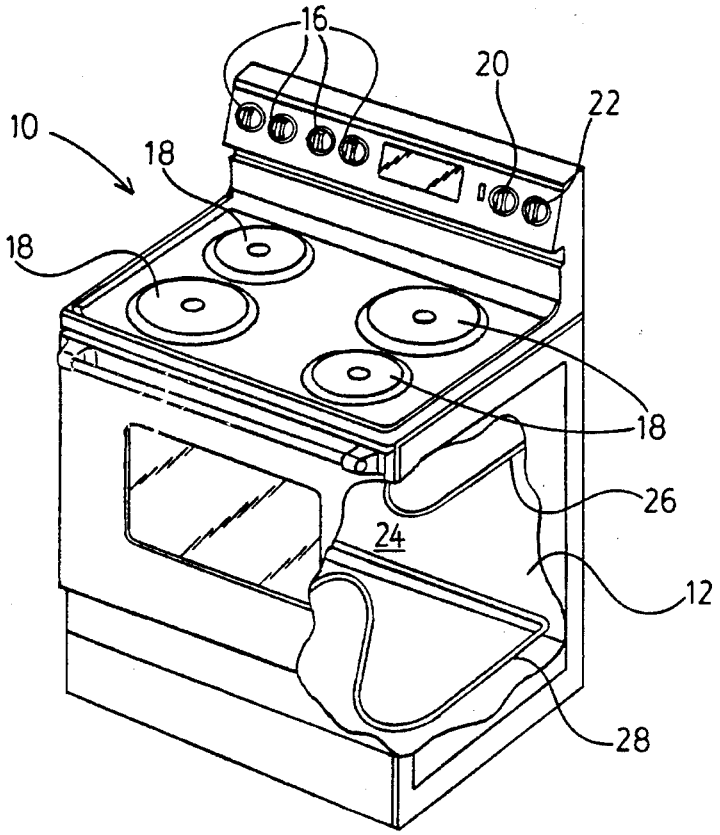
FIG. 1 illustrates a self-cleaning electric range having an oven adapted to be controlled by an oven temperature control system and method constructed in accordance with the principles of the present invention.
Figure 2:
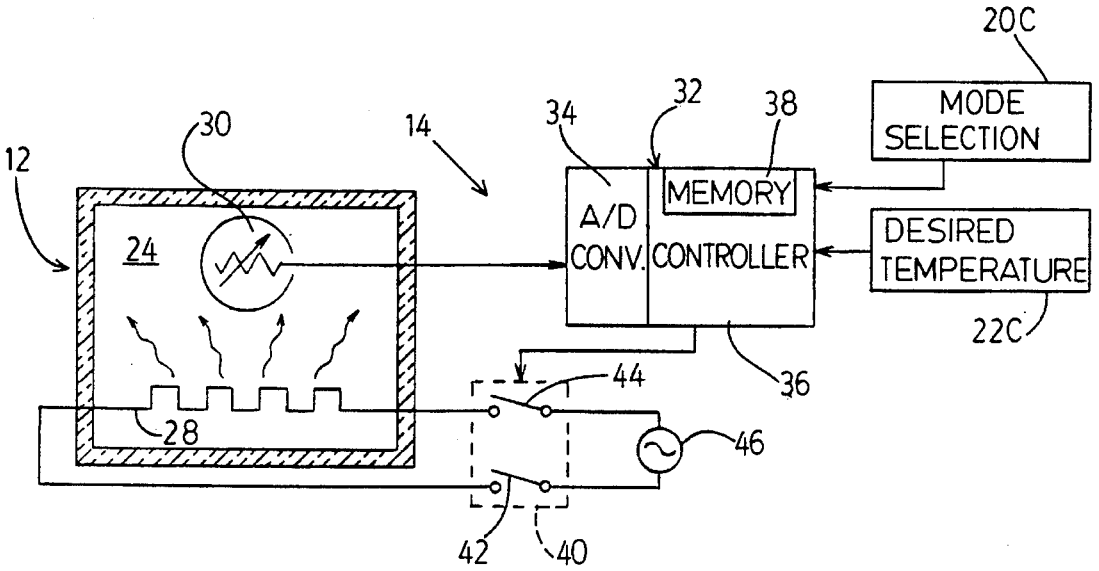
FIG. 2 illustrates a schematic view of a digital electronic microprocessor based oven temperature control system designed to be operated in accordance with the principles of the present invention.

Referring to the drawings and specifically to FIGS. 1 and 2, an electric range 10 is generally illustrated having a self-cleaning oven 12 adapted to be controlled by a microprocessor based control system 14 and a method in accordance with the principles of the present invention. Although an electric range 10 is illustrated, it should be understood that a gas range may implement the features of the present invention.

The range 10 includes a plurality of control knobs 16 for controlling a respective plurality of conventional electric (or gas) burners 18. In addition, the range 10 includes a control knob 20 for controlling a mode of operation of the oven 12. For example, an OFF mode, a BAKE mode, a BROIL mode, and a CLEAN mode of operation may be selected by the control knob 20. In addition, a control knob 22 is conventionally provided to select a desired oven temperature within the oven 12. Disposed within a cavity 24 of the oven 12 are a conventional broiling element 26 and a conventional heating element 28. Furthermore, positioned within the cavity 24 of the oven 12 is a conventional temperature sensor 30, such as, for example, a standard oven temperature sensing probe.

The microprocessor based control system 14 includes a microprocessor 32 suitably programmed to affect the desired control of the range 10. More particularly, the oven 12 may be suitably controlled, for example, during a clean mode of operation in accordance with the principles of the present invention.

Conventionally, the microprocessor 32 includes an analog-to-digital (A/D) converter 34 for receiving analog voltage input signals from, for example, the temperature sensor 30 and for providing digital output pulses or signals to a controller section 36 within the microprocessor 32. Conventionally, the microprocessor 32 includes a memory 38 for retaining programmed instructions for operating the control system 14 including a desired oven temperature control algorithm for controlling the temperature of the oven 12, particularly during the clean mode of operation.

The control system 14 also includes a power switching relay 40 having a pair of relay contacts 42 and 48 for switching power to a heating element, for example, the baking element 28, from a constant voltage (e.g. 240 volts) source 46 of alternating current electric power under the control of the controller 36. For simplification, only the baking element 28 and the power relay 40 therefor have been illustrated in FIG. 2 in the control system 14. In an actual commercial embodiment, however, the broiling element 26 could, of course, be a part of the control system 14 along with its own power switching relay to interconnect the broiling element 26 to the source 46. The broiling element 26 is used in conjunction with the heating element 28 during the broil mode of operation of the oven 12 and may further be used during the bake and clean modes of the oven 12 to provide sufficient heat to the oven 12 under the control of the controller 36.

During a bake mode of operation, the baking element 28 is energized by the source 46 through the relay 40 under the control of the controller 36 to heat and raise the temperatures of items to be cooked within the oven cavity 24 of the oven 12. The sensor 30 is typically disposed within the oven cavity 24 and is used to provide an output analog voltage signal as an input to the A/D converter 34. The analog input signal is converted to a digital output signal and is supplied to the memory 38 and the controller 36 for controlling the on-off state of the relay 40 and, therefore, the energization of the baking element 28.

As is conventional, a user of the range 10 selects, by means of the control knob 20, the desired mode of operation of the oven 12. The mode selection is provided as an input to the microprocessor 32 by a conventional mode selection circuit 20*c*. If the bake mode of operation of the oven 12 has been selected, the user also selects a desired bake temperature by means of the control knob 22. The desired temperature is also provided as an input signal to the microprocessor 32 by a conventional desired temperature circuit 22*c*. The microprocessor 32 through the controller 36 controls the state of the power relay 40 to energize or de-energize the baking element 28 as a function of the actual oven temperature as sensed by the sensor 30 and of the desired temperature as provided by the desired temperature circuit 22*c*. The broiling element 26 may be similarly controlled to provide additional heat during the bake mode.

During the broil mode of operation, the broiling element 26 is energized or de-energized through an associated power relay under the control of the controller 36 of the microprocessor 32. If the clean mode of operation is selected, the energization of one or both of the broiling element 26 and the baking element 28 occurs under the control of the microprocessor 32 to maintain the temperature 12 at a cycling cleaning temperature as depicted in FIG. 3 and control of which is depicted in the flowchart illustrated in FIG. 4.

Figure 3:
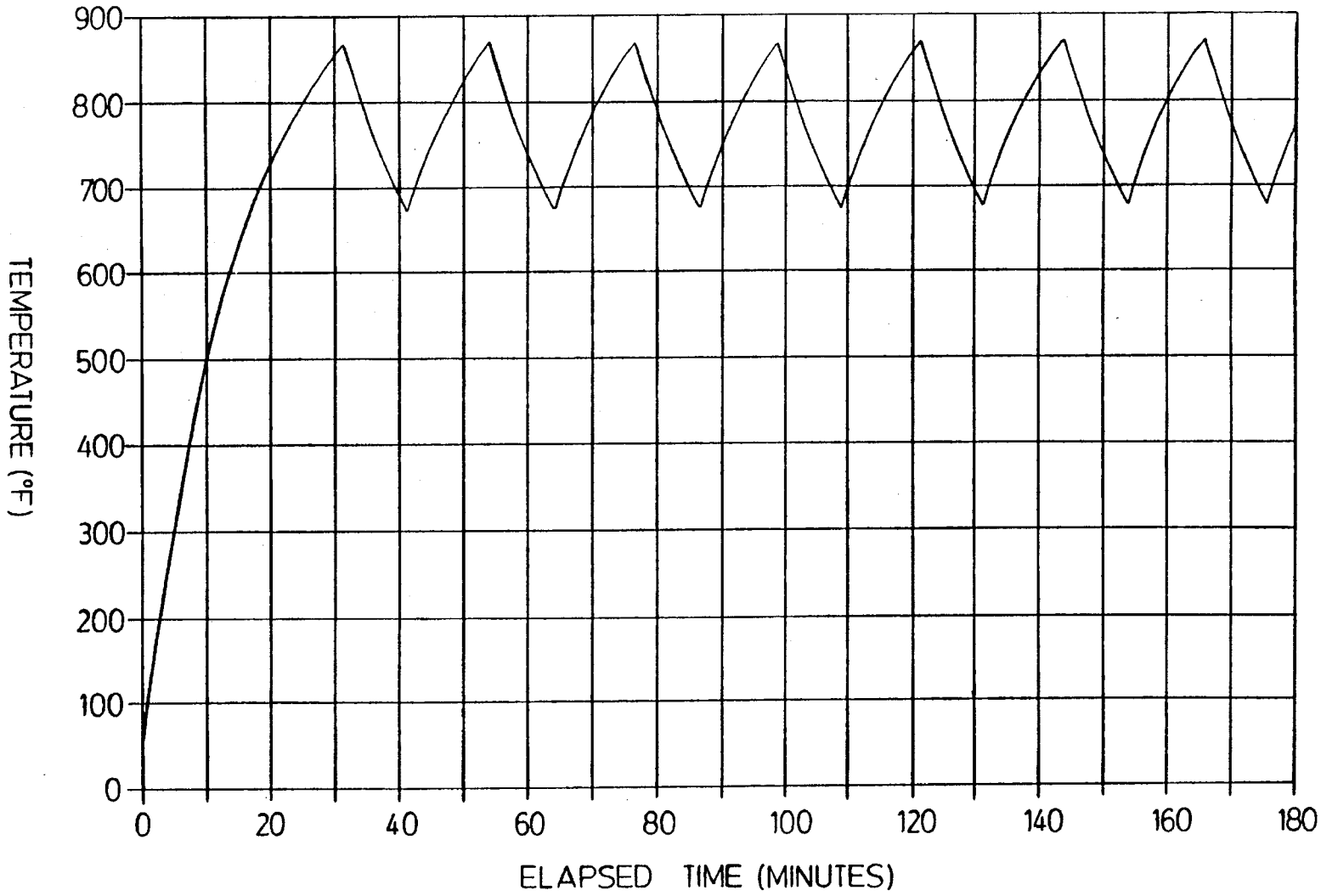
FIG. 3 illustrates a graph of oven temperatures over time for the digital electronic microprocessor based oven temperature control system operating in accordance with the principles of the present invention.
Figure 4:
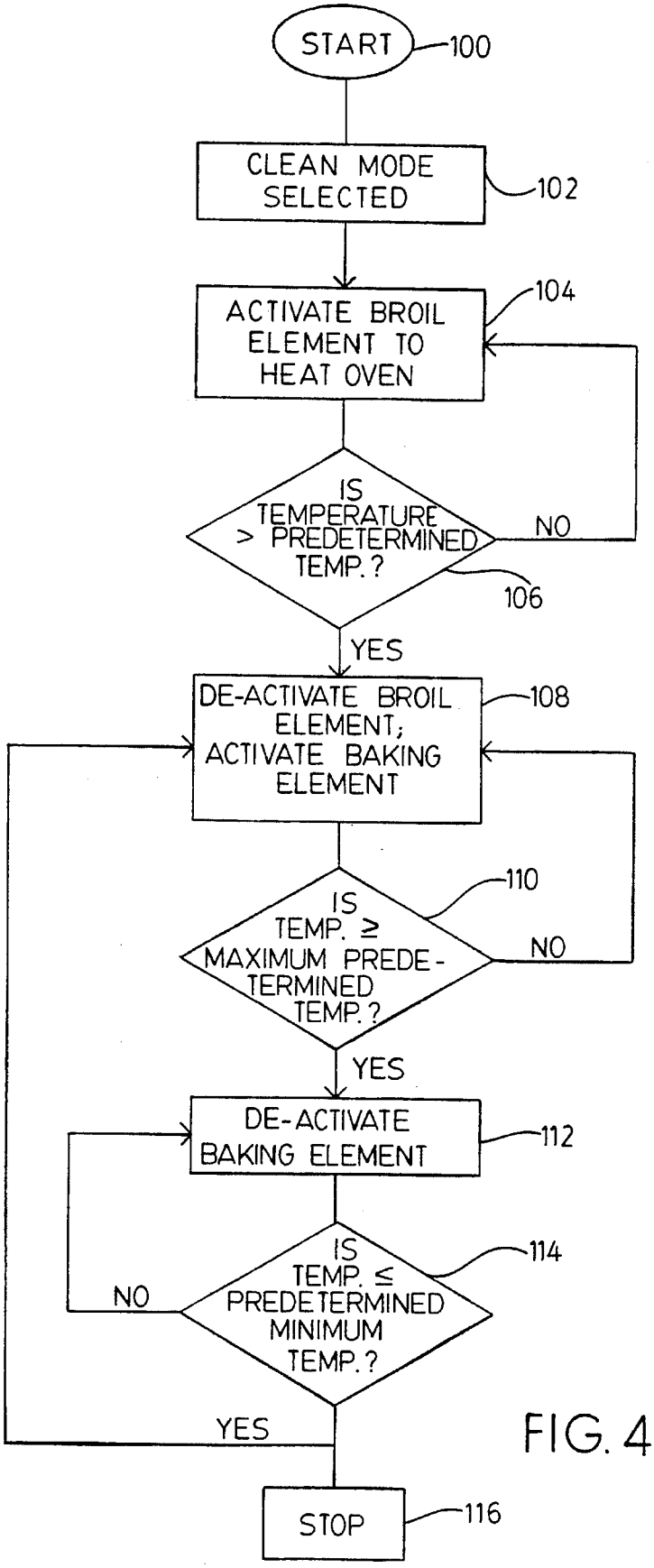
FIG. 4 illustrates a flowchart of the operational functions in the clean mode of operation in accordance with the principles of the present invention.

Referring now to FIGS. 3 and 4, to operate the oven 12 in the clean mode, the clean mode is first selected as illustrated at 102. The broiling element 26 is activated at one-hundred percent power to heat the oven to a predetermined temperature, such as, for example, 700° F. After the predetermined temperature is reached as illustrated at 106 and 108 in FIG. 4, the broiling element 26 is de-activated and the baking element 28 is activated at one-hundred percent power. The baking element 28 continues to heat the cavity 24 of the oven 12 until a predetermined maximum temperature is reached as illustrated at 110 and 112.

After the predetermined maximum temperature is reached, the baking element 28 is de-activated, and the temperature within the cavity 24 of the oven 12 is reduced to a predetermined minimum temperature. After the predetermined minimum temperature is reached, the baking element 28 is re-activated, and the cycle is continued wherein activation and de-activation of the baking element 28 is effected such that the temperature within the cavity 24 of the oven 12 cycles between the predetermined maximum temperature and the predetermined minimum temperature for an indefinite time period. Of course, one of ordinary skill in the art could program a time for the clean mode of operation of the oven 12 such that cleaning occurs for a predetermined time period only.

As illustrated in FIG. 3, in a preferred embodiment, the maximum temperature is approximately 875° F. and the minimum temperature is approximately 675° F. A maximum temperature of 875° has been identified as the temperature required in order to effect complete cleaning of the oven 12. However, in accordance with the principles of the present invention, this maximum temperature is not required to be maintained throughout the clean mode in order to effect complete cleaning thereof during the clean mode. Further, in accordance with the principles of the present invention, complete cleaning of the oven 12 may be effected in a reasonable time period, i.e. approximately three hours, as long as the temperature reaches a temperature at or near the maximum temperature at least once during the time period. However, more effective and efficient cleaning times are provided when cycling to the maximum temperature is conducted a plurality of times during the time period for cleaning. That is, a cycle time is established during the time period for cleaning wherein the cycle time is defined as the time at which the temperature is at the maximum temperature to the time it returns to the maximum temperature between which the minimum temperature is reached. The cycle time, in a preferred embodiment, is less than thirty minutes with heating to the maximum temperature requiring only slightly more time than the decrease of temperature within the cavity 24 of the oven 12 to the minimum temperature.

Following completion of the clean mode of operation, typically in approximately three hours, the clean mode may be stopped as shown at 116 of FIG. 4. The temperature within the cavity 24 of the oven 12 may then be reduced to its room temperature or other temperature selected by the temperature control in another mode of operation, such as the bake mode.

As a result of the foregoing cycling of temperatures during the clean mode of operation, the average temperature of the oven during the clean mode is substantially reduced, preferably below 800° F., without reducing the performance required for cleaning and further without requiring additional time for cleaning.

In a preferred embodiment, the average temperature is 777° F. with a 200° F. amplitude between the maximum temperature and the minimum temperature to maintain the 777° F. average temperature for three hours. The baking element, in a preferred embodiment, is rated at 2800 watts and the broiling element is rated at 3000 watts at 240 volts AC.

As a result of the foregoing cleaning operation, the life of the relays and the contacts is increased by approximately seventy-five percent since less cycling is required. Further, a lower average temperature during cleaning is achieved permitting a faster cool-down time and reducing the cost of certain components by de-rating them to lower temperature requirements. Still further, during cleaning, smoke normally produced from cleaning is significantly reduced because a center vent catalyst is reached at a faster rate than that currently available.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A self-cleaning oven comprising:

a housing having an interior constructed and arranged to receive items to be cooked within the housing;

heating means within the housing wherein the heating means raises the temperature of the interior of the housing; and control means operative to control operation in a plurality of modes including a clean mode wherein the control means is operatively connected to the heating means to maintain a self-cleaning temperature in the housing, the control means raises the temperature to a maximum cleaning temperature of approximately 875° F. and not to exceed 900° F. and maintains an average self-cleaning temperature between 700° and 800° F. and further wherein the control means cycles the self-cleaning temperature through a predetermined range in the housing to maintain the average self-cleaning temperature by selectively activating and deactivating the heating means.

2. The self-cleaning oven of claim 1 further comprising:

sensing means within the interior of the housing and providing a signal indicative of the temperature in the interior to the control means.

3. The self-cleaning oven of claim 1 wherein the average self-cleaning temperature is maintained with the maximum temperature not to exceed 875° F. during the clean mode.

4. The self-cleaning oven of claim 1 wherein the predetermined range is approximately 200° F.

5. The self-cleaning oven of claim 1 wherein the control means includes a microprocessor.

6. The self-cleaning oven of claim 1 further comprising:

mode selection means connected to the control means wherein the control means is operative in response to a signal from the mode selection means.

7. A method for controlling operation of a self-cleaning oven having a housing with an interior and heating means within the interior for raising temperature of the interior and a controller for operating the oven in at least a bake mode and a clean mode, the method further comprising the steps of:

selecting the mode of operation for the interior of the housing;

sensing the temperature of the interior during the clean mode;

controlling the heating means during operation of the oven in the clean mode wherein a maximum temperature of approximately 875° F. and not to exceed 900° F. is reached and an average cleaning temperature during the clean mode is between 700° and 800° F.; and cycling the temperature through a predetermined range to maintain the average cleaning temperature.

8. The method of claim 7 wherein the predetermined range is approximately 200° F.

9. The method of claim 7 wherein the cycling of the temperature throughout the predetermined range is controlled by alternately activating and deactivating the heating means.

10. A method for maintaining an average cleaning temperature for cleaning a self-cleaning oven, the method comprising the steps of:

selecting a clean mode of operation for the oven;

increasing the temperature within the oven to a first temperature of approximately 875° F. and not to exceed 900° F.;

decreasing the temperature within the oven to a second temperature substantially below the first temperature; and automatically cycling the temperature alternately over a predetermined range between the first temperature and the second temperature to maintain the average cleaning temperature between 700° and 800° F. in the clean mode of operation of the oven.

11. The method of claim 10 wherein the predetermined range between the first temperature and the second temperature during the cycling step is approximately 200° F.

12. The method of claim 10 further comprising the step of:

maintaining substantially equal cycle times for increasing and decreasing of the temperatures.

13. The method of claim 10 further comprising the step of:

limiting the cycle time to not exceed thirty minutes.

14. The method of claim 10 further comprising the step of:

activating a broil element of the oven to initially assist in reaching the first temperature.

15. The method of claim 10 further comprising the step of:

utilizing a bake element of the oven during the cycling between the first temperature and the second temperature.

16. The method of claim 15 wherein the bake element is utilized at one-hundred percent power during the cycling between the first temperature and the second temperature.

* * * * *